US006937161B2

(12) United States Patent
Nishimura

(10) Patent No.: US 6,937,161 B2
(45) Date of Patent: Aug. 30, 2005

(54) TRAFFIC SIGNAL CONTROL METHOD

(75) Inventor: Shigeki Nishimura, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 36 days.

(21) Appl. No.: 10/408,578

(22) Filed: Apr. 8, 2003

(65) Prior Publication Data

US 2003/0210156 A1 Nov. 13, 2003

(30) Foreign Application Priority Data

May 13, 2002 (JP) ..... 2002-137494

(51) Int. Cl.[7] ..... G08G 1/07

(52) U.S. Cl. ..... 340/917; 340/916; 340/918; 340/919; 340/921

(58) Field of Search ..... 340/907, 916, 340/917, 919, 921, 922, 923, 929, 933, 918; 701/117, 118, 119

(56) References Cited

U.S. PATENT DOCUMENTS

| | | | | |
|---|---|---|---|---|
| 3,631,387 A | * | 12/1971 | Hill et al. | 340/923 |
| 4,303,905 A | * | 12/1981 | Drebinger | 340/922 |
| 4,433,324 A | * | 2/1984 | Guillot | 340/923 |
| 5,444,442 A | | 8/1995 | Sadakata et al. | |
| 6,333,701 B1 | * | 12/2001 | Mee et al. | 340/907 |
| 6,339,383 B1 | * | 1/2002 | Kobayashi et al. | 340/907 |

FOREIGN PATENT DOCUMENTS

| | | | |
|---|---|---|---|
| GB | 2165982 A | * | 4/1986 |
| GB | 2198272 A | * | 6/1988 |
| JP | 63-37500 | | 2/1988 |
| JP | 64-43496 | | 3/1989 |
| JP | 6-150187 | | 5/1994 |
| JP | 07-160991 | | 6/1995 |
| JP | 07-282389 | | 10/1995 |
| JP | 11-203592 | | 7/1999 |
| JP | 2000-036096 A | | 2/2000 |
| JP | 2001-134893 A | | 5/2001 |
| JP | P2002-24990 A | | 1/2002 |

* cited by examiner

*Primary Examiner*—Van T. Trieu
(74) *Attorney, Agent, or Firm*—McDermott Will & Emery LLP

(57) ABSTRACT

In traffic signal control for setting a green light time to a value between the lower limit time and the upper limit time in real time depending on a traffic volume sensed by vehicle sensors Sa, Sb, and so forth, the upper limit time $G_{max}$ is set longer with an increase of a traffic volume on an access road corresponding to a phase in question (Steps T8 and T9). This arrangement is effective for use at an intersection where a traffic volume in one direction is far heavier than in any other direction, and thereby makes it possible to forestall the occurrence of traffic jam (FIG. 6).

3 Claims, 6 Drawing Sheets

TRAFFIC SIGNAL CONTROL METHOD

This application is based on application No. 2002-137494 filed in Japan on May 13. 2002, the content of which is incorporated hereinto by reference.

BACKGROUND OF THE INVENTION

1. Field of the Invention

The present invention relates to a traffic signal control method for setting a time on a green light (hereinafter, referred to as the green light time) to a value between the lower limit time and the upper limit time in real time depending on a traffic volume sensed by a vehicle sensor or the like.

2. Description of the Related Art

Conventionally, the green light time of a traffic signal is controlled in the manner as follows.

Vehicle sensors (a device capable of detecting a passing vehicle, such as an inductive loop sensor, an ultrasonic sensor and a camera; ditto for the description below) are set up for respective access roads to an intersection, and in a case where a traffic volume (the number of passing vehicles per unit time) is less than a predetermined value when the lower limit time has passed since the traffic signal turned to a green light, the green light is turned off and the control flow proceeds to the following step (yellow light). The green light time is extended in a case where the traffic volume is equal to or greater than the predetermined value. It should be noted, however, that the green light is turned off forcedly regardless of the traffic volume when the upper limit time has passed, and the control flow proceeds to the following step (yellow light).

Because the upper limit time is fixed in the conventional method, the green light time cannot be extended over the upper limit time even in a case where a traffic volume in one direction is far heavier than in any other direction, for example. However, traffic jam (an extraordinary large number of vehicles are waiting on a red light) will not be solved unless the green light time is extended as needed over the upper limit time.

Accordingly, there has been an increasing need for a traffic signal control method capable of setting the upper limit time of a green light flexibly in real time depending on a traffic volume.

BRIEF SUMMARY OF THE INVENTION

It is therefore an object of the invention to provide a traffic signal control method capable of setting the upper limit time of a green light flexibly in real time depending on a traffic volume.

A traffic signal control method of the invention is a method of setting the upper limit time of a green light longer with an increase of a traffic volume on an access road corresponding to a phase in question. According to this method, the upper limit time of a green light can be extended as a traffic volume becomes heavier, which makes it possible to forestall the occurrence of traffic jam in a case where a traffic volume in one direction is far heavier than in any other direction.

According to the traffic signal control method of the invention, the upper limit time of a green light may be set longer with an increase in value of a sum of the traffic volume and the number of vehicles waiting on a red light per cycle on an access road corresponding to a phase in question. The number of vehicles waiting on a red light referred to herein means the number of vehicles that were not able to pass through an intersection before a green light was turned off and remain on the access road. If the upper limit time is set based on a traffic volume passing through an intersection alone, a demanded traffic volume cannot be estimated accurately in a supersaturated situation where an extremely large number of vehicles are waiting on a red light. Hence, in terms of preventing the occurrence of traffic jam, it is more effective to set the upper limit time by taking the actual number of vehicles waiting on a red light into account.

A vehicle sensor may be used to count the number of vehicles waiting on a red light. However, in order to count the number of vehicles waiting on a red light in a long line, the vehicle sensor has to be set up at a position away from an intersection, which increases the set-up cost. In addition, the vehicle sensor may fail in counting due to weather. Thus, it is easier to judge the presence of any vehicle waiting on a red light by checking whether the green light time in the last cycle had reached the upper limit time. Herein, the presence of vehicles waiting on a red light is presumed in a case where the green light time had reached the upper limit time, and a predetermined set value is given to the number of vehicles waiting on a red light. Hence, the traffic signal control method of the invention sets the upper limit time in the current cycle through the use of a traffic volume in the past cycle and a set value given to the number of vehicles waiting on a red light. A traffic volume in the past cycle referred to herein may be, for example, a traffic volume in the last cycle or an average value of traffic volumes in several cycles in the past including the last cycle.

It should be noted that the upper limit time in the first cycle cannot be set as described above due to the absence of the last cycle. This problem, however, can be solved by giving a specific default value to the initial upper limit time.

Also, to be more concrete, a traffic signal control method of the invention performs processing (a) through processing (d) as follows:

(a) in a case where a green light time in a last cycle had reached an upper limit time, a load factor $\lambda$ in one phase is found in accordance with an equation: $\lambda=(Q+E)/S$, where Q is the number of vehicles (vehicles/time) on an access road corresponding to the phase sensed in a past cycle, E is a set value given to the number of vehicles (vehicles/time) waiting on a red light on the access road corresponding to the phase, and S is a saturation traffic volume (vehicles/time) on the access road corresponding to the phase, and in a case where the green light time in the last cycle had not reached the upper limit time, the load factor $\lambda$ is calculated in accordance with an equation:

$$\lambda=Q/S;$$

(b) the processing (a) is performed for any other phase;

(c) when the processing (a) is completed for all phases, an upper limit time for each phase is determined by distributing a value obtained by subtracting a predetermined constant time L from a maximum cycle length (fixed value) to the upper limit times in respective phases according to a ratio of the load factors $\lambda$ in the respective phases; and (d) a green light time in a phase in question is set to a value between a lower limit time and the upper limit time, determined in the processing (c) above, in real time depending on a traffic volume sensed by a vehicle sensor.

According to this method, the upper limit time in each phase can be determined by calculating the load factor $\lambda$ in each phase, and by distributing a value obtained by subtracting the predetermined constant time L from the maximum cycle length (fixed value) to the upper limit times in the respective phases according to a ratio of the load factors λ in the respective phases.

More than one phase is involved in the traffic signal control at an intersection. The traffic signal control described above may be performed for a part of all the phases. This is because in a case where there are three or more phases, a part of which (for example, pedestrian lights) may not have to respond to a traffic volume.

DETAILED DESCRIPTION OF THE INVENTION

The following description will describe one embodiment of the invention in detail with reference to the accompanying drawings. In this embodiment, vehicles keep to the left.

Figure 1:
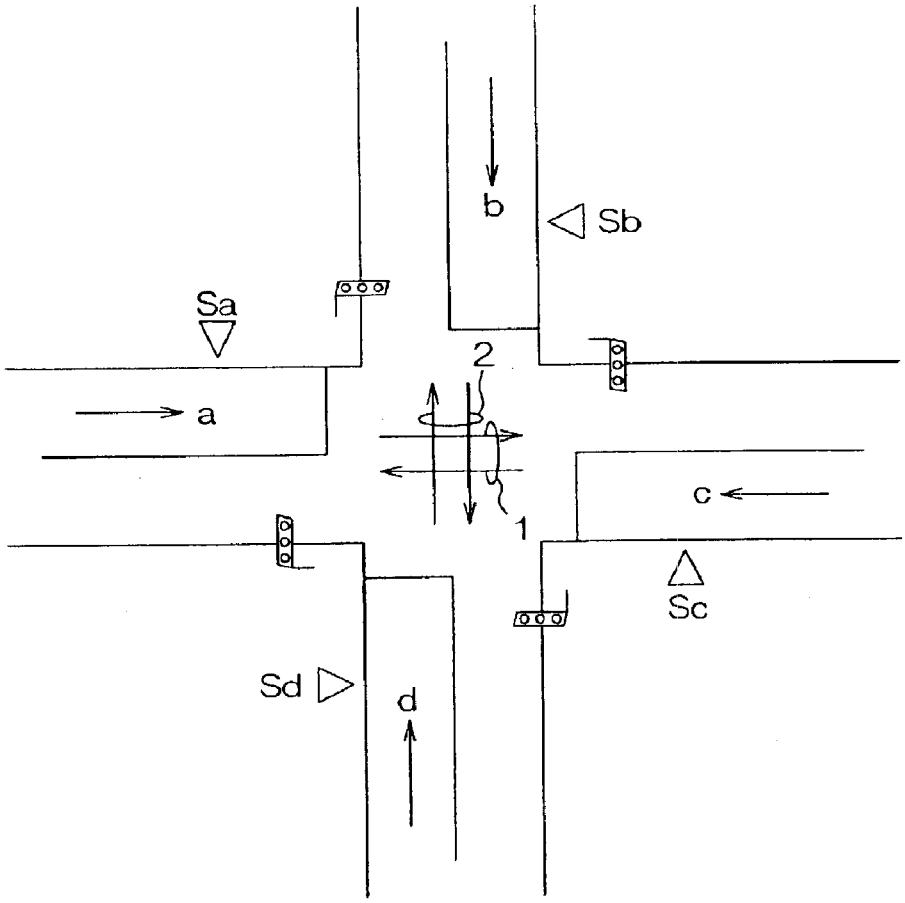
FIG. 1 is a plan view showing an intersection.

FIG. 1 is a plan view showing an intersection. Access roads are denoted by lower case letters a, b, c, and d, respectively. A vehicle sensor Sa is set up for the access road a, and likewise, vehicle sensors Sb, Sc, and Sd are set up for the access roads b, c, and d, respectively.

Changes of lights of the respective traffic signals for one cycle are set forth in Table 1 below.

TABLE 1

| | 1 CYCLE | | | | | |
|---|---|---|---|---|---|---|
| PHASE | PHASE 1 | | | PHASE 2 | | |
| STEP | 1 | 2* | 3* | 4 | 5* | 6* |
| ROAD a | GREEN | YELLOW | RED | RED | RED | RED |
| ROAD b | RED | RED | RED | GREEN | YELLOW | RED |
| ROAD c | GREEN | YELLOW | RED | RED | RED | RED |
| ROAD d | RED | RED | RED | GREEN | YELLOW | RED |

*Fixed Time

A period needed for the traffic signal to turn from a green light to a yellow light to a red light and to a green light again is defined as one cycle. Herein, let C be the time length of one cycle.

A time needed for the traffic signals on the access roads b and d to turn to a green light since the traffic signals on the access roads a and c turned to a green light is defined as PHASE 1, and a time needed for the traffic signals on the access roads a and c to turn to a green light since the traffic signals on the access roads b and d turned to a green light is defined as PHASE 2.

One cycle is divided into PHASE 1 and PHASE 2. PHASE 1 is composed of three steps, STEP 1 through STEP 3, and PHASE 2 is also composed of three steps, STEP 4 through STEP 6. When the attention is directed to the access road a, the traffic signal turns from a green light to a yellow light to a red light in STEP 1 through STEP 3, respectively, and remains on a red light in STEP 4 through STEP 6. When the attention is directed to the access road b while the traffic signal on the access road a remains on a red light in STEP 4 through STEP 6, the traffic signal turns from a green light to a yellow light to a red light, respectively.

Predetermined constant times are given to continuous times of STEPs 2, 3, 5, and 6. Herein, let L be a sum of these times. The continuous time of STEP 1 in PHASE 1 is defined as a green light time G1, and the continuous time of STEP 4 in PHASE 2 is referred to as a green light time G4. Hence, one cycle is expressed as G1+G4+L.

Figure 2:
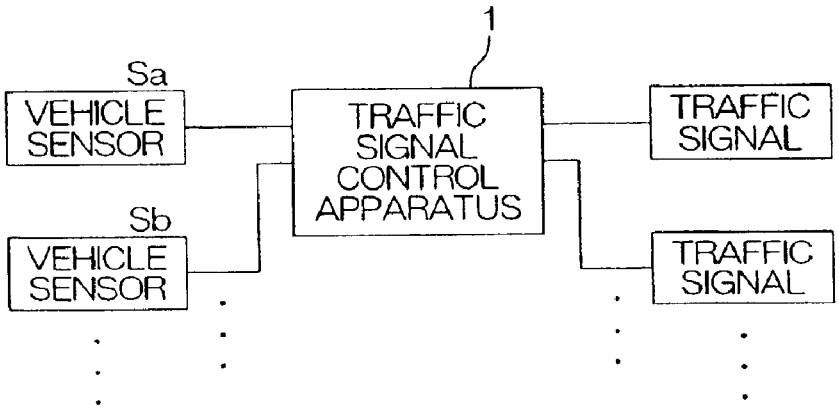
FIG. 2 is an electrical schematic diagram of a traffic signal control apparatus.

FIG. 2 is an electrical schematic diagram of a traffic signal control apparatus 1 for implementing the traffic signal control method of the invention. The traffic signal control apparatus 1 performs traffic signal control computation using signals from the vehicle sensors Sa, Sb, and so forth within the responsible area as an input, and supplies the respective traffic signals with control output signals.

The traffic signal control computation is achieved by running a program recorded in a specific medium, such as a memory and a hard disc, on the computer installed in the traffic signal control apparatus 1.

The green light time G1 and the green light time G4 are determined in real time in the manner as follows.

A method of measuring the green light time G1 will be explained first with reference to the flowchart of FIG. 3.

Herein, the lower limit time $G_{min1}$ and the upper limit time $G_{max1}$ are set in advance for the green light time G1. In the invention, a constant is given to the lower limit time $G_{min1}$ whereas the upper limit time $G_{max1}$ is calculated depending on a traffic volume as will be described below.

Figure 3:
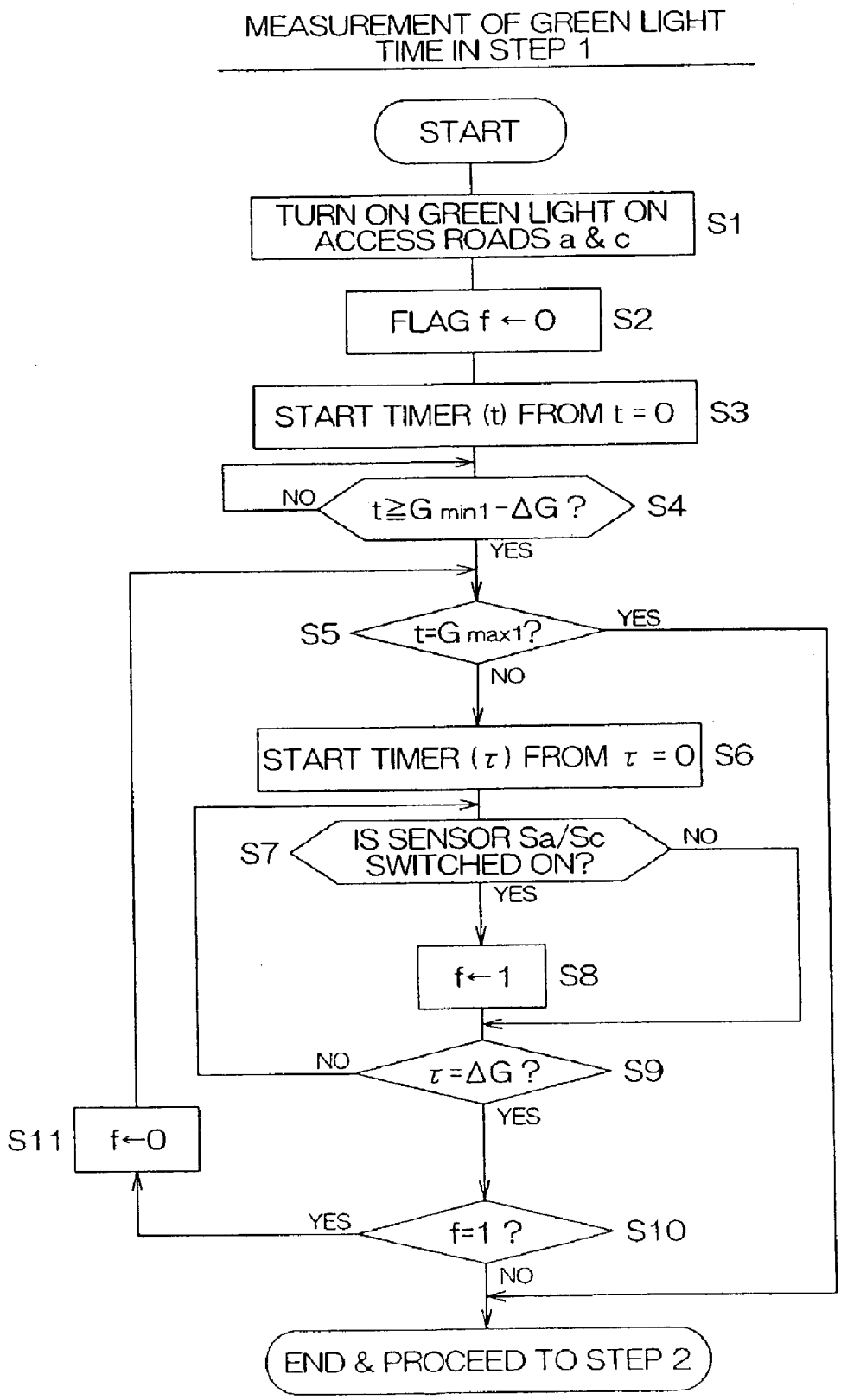
FIG. 3 is a flowchart detailing a method of measuring a green light time G1.

Referring to FIG. 3, when a green light corresponding to PHASE 1 is turned on (Step S1), an extension flag f is set to 0 (Step S2). Then, a timer (t) that measures a green light time t is started (Step S3).

The flow proceeds to Step S5 when the measured time t reaches the lower limit time $G_{min1}-\Delta G$. Herein, ΔG is a unit used to extend the green light time.

In Step S5, whether the measured time t has reached the upper limit time $G_{max1}$ is checked. When the measured time t has reached the upper limit time $G_{max1}$, STEP 1 is terminated and the flow proceeds to following STEP 2. As a consequence, when the attention is directed to the access road a, the traffic signal turns from a green light to a yellow light.

When the measured time t has not reached the upper limit time $G_{max1}$ in Step S5, another timer (τ) is started (Step S6). This timer (τ) is started when $t=G_{min1}-\Delta G$ and thereby measures the green light time extension unit ΔG.

Subsequently, whether either of the vehicle sensors Sa and Sc is switched on during ΔG is judged (Step S7). When either of the vehicle sensors Sa and Sc is switched on (that is, when a vehicle has passed), the extension flag f is set to 1 (Step S8); otherwise, the extension flag f remains at 0.

When a measured time τ reaches ΔG (Step S9), whether the extension flag f is 1 or 0 is judged (Step S10). In the case of f=0, STEP 1 is terminated and the flow proceeds to following STEP 2.

Hence, a green light is not extended when there is no passing vehicle (traffic volume), and the traffic signal thereby remains on a green light until the lower limit time $G_{min1}$ has passed and then changes to a yellow light.

When there is a traffic volume, the green light is extended by ΔG.

Subsequently, the extension flag f is set to 0 again (Step S11), and the flow returns to Step S5, where a traffic volume is checked during another extension unit ΔG, and whether extension is needed or not is determined based on the absence or presence of a traffic volume.

When the measured time t reaches the upper limit time $G_{max1}$ while the above processing is repeated, STEP 1 is terminated and the flow proceeds to following STEP 2.

Hence, in a case where a green light has continued as long as the upper limit time $G_{max1}$, there is left one or more than one vehicle that was not able to pass through an intersection before the green light was turned off. These vehicles have to wait on a red light at the intersection until the traffic signal turns to a green light again.

The above description described the measuring method of the green light time G1, and it should be appreciated that the green light time G4 in PHASE 2 can be determined in exactly the same manner.

Figure 4:
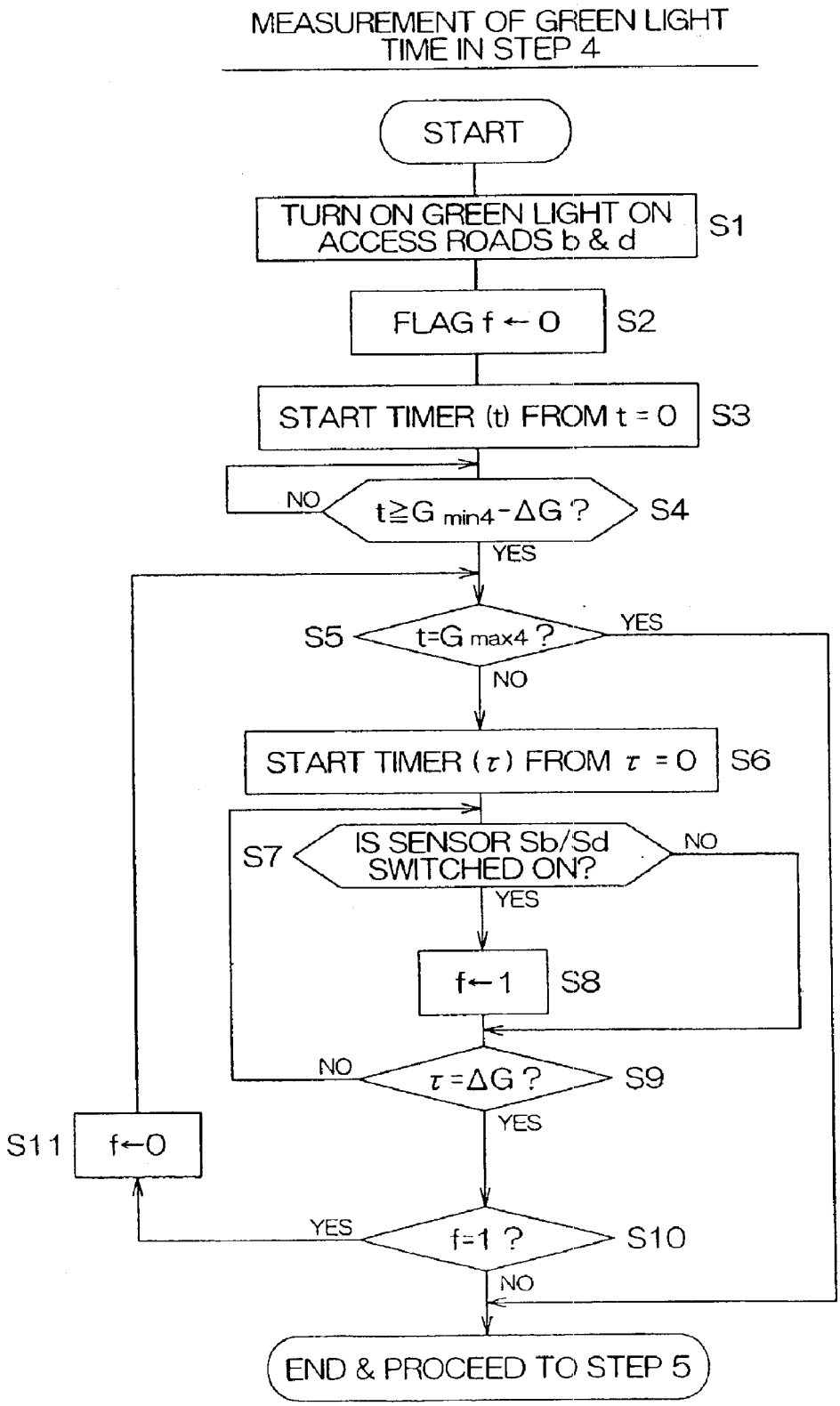
FIG. 4 is a flowchart detailing a method of measuring a green light time G4.

FIG. 4 shows a flowchart detailing the measuring method of the green light time G4. The flowchart is substantially the same as that of FIG. 3 except that the lower limit time $G_{min1}$ and the upper limit time $G_{max1}$ are replaced with the lower limit time $G_{min4}$ and the upper limit time $G_{max4}$, respectively, and the description is omitted for ease of explanation.

Figure 5:
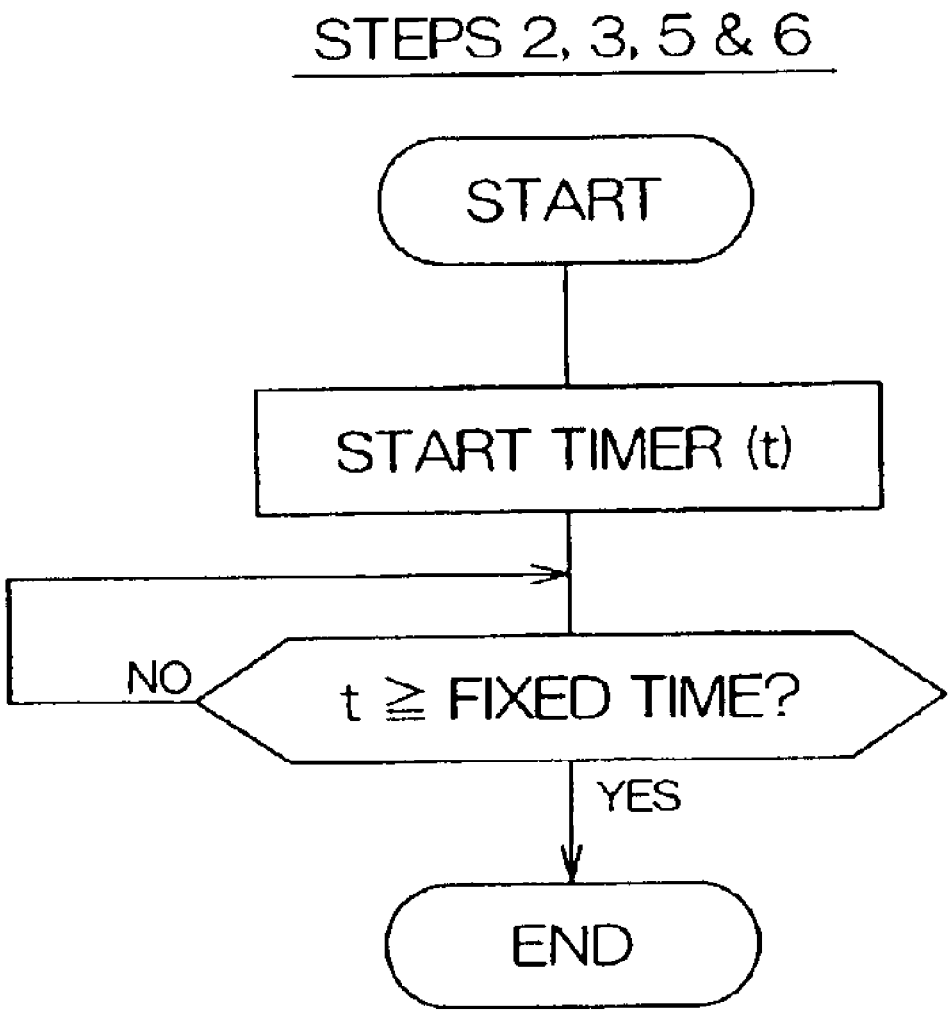
FIG. 5 is a flowchart detailing a method of measuring a signal time in each of STEPs 2, 3, 5, and 6.

The measurement of signal times in STEPs 2, 3, 5, and 6 are not complicated because they are predetermined constant times. The flowchart of such measurement is shown in FIG. 5.

Figure 6:
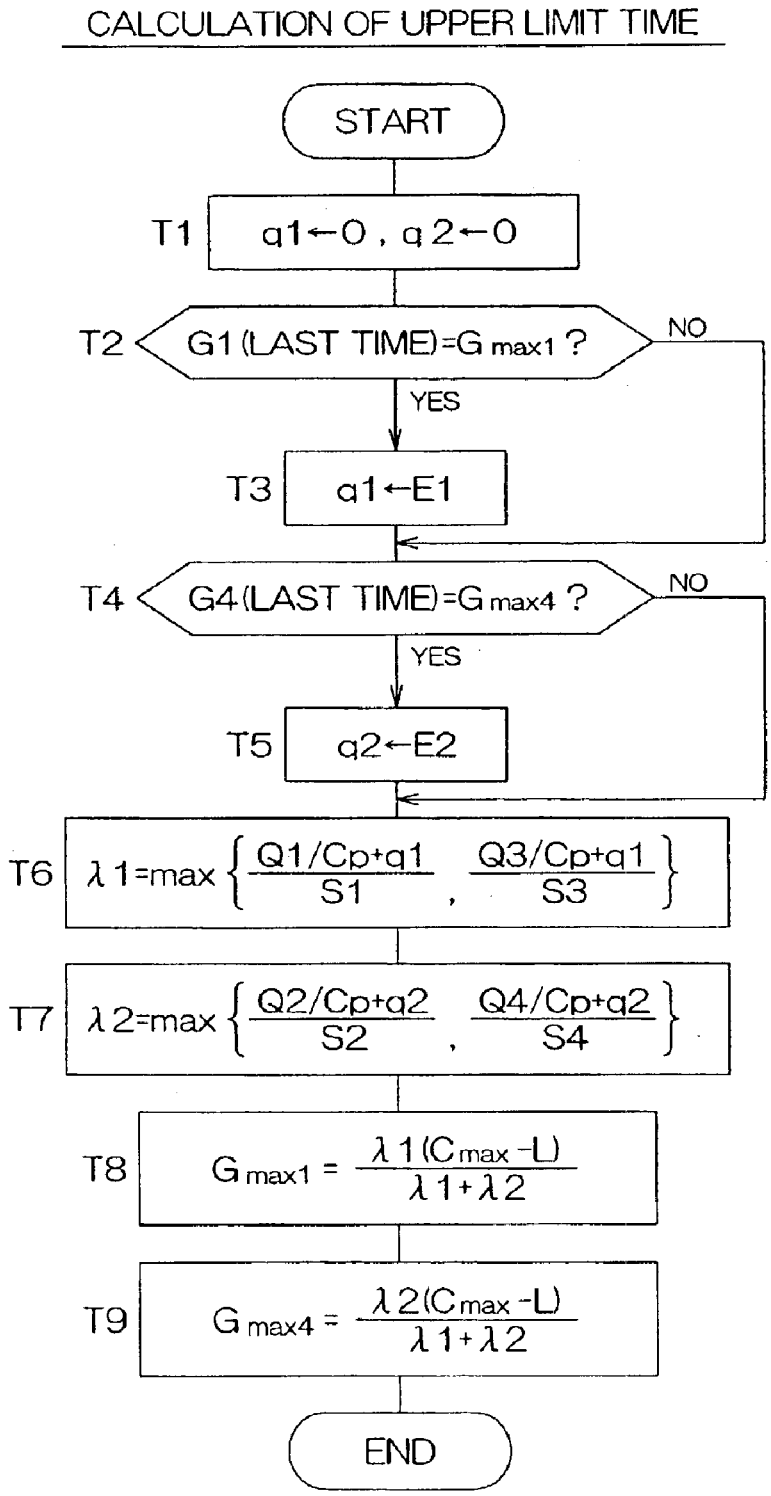
FIG. 6 is a flowchart detailing a method of calculating upper limit times $G_{max1}$ and $G_{max4}$.

A method of calculating the upper limit times $G_{max1}$ and $G_{max4}$, which is characteristic to the invention, will now be explained with reference to a flowchart (FIG. 6).

The processing of FIG. 6 is performed once in one cycle, and has to be completed before the lower limit time $G_{min1}$ has passed (when YES is returned in Step S4).

Initially, parameters q1 and q2 are set to 0 (Step T1) Then, whether the green light time G1 in STEP 1 in the last cycle had reached the upper limit time $G_{max1}$ is checked (Step T2).

Because the upper limit time of the last cycle is used in calculating the upper limit time of the current cycle, the initial upper limit time (when the traffic signal is set up for the first time) cannot be calculated in accordance with this method. For this reason, a predetermined default value is given to the initial upper limit time.

When the green light time G1 in STEP 1 in the last cycle had reached the upper limit time $G_{max1}$, q1 is set to E1 (Step T3).

Then, whether the green light time G4 in STEP 4 in the last cycle had reached the upper limit time $G_{max4}$ is checked (Step T4). When the green light time G4 had reached the upper limit time $G_{max4}$, q2 is set to E2 (Step T5).

Herein, E1 and E2 correspond to the numbers of vehicles (vehicles/sec) waiting on a red light per cycle. E1 and E2 may be the values actually counted in the last cycle, which, however, increases the burden of a responsible party due to the need to set up more than one vehicle sensor away from an intersection. Hence, it is practical to give a constant set value obtained from experiments. When there is a tendency in the number of vehicles waiting on a red light depending on the time of day, a day of the week, weather, situations with or without an event, etc., it is preferable to give set values corresponding to the current time of day, day of the week, weather, and situations with or without an event, etc.

Subsequently, a load factor λ1 in PHASE 1 and a load factor λ2 in PHASE 2 are determined.

The load factor λ1 is one of (Q1/Cp+q1)/S1 and (Q3/Cp+q1)/S3 whichever is the greater (Step T6), where:

Q1 is the number of vehicles (vehicles) sensed by the vehicle sensor Sa on the access road a in the last cycle;

Q3 is the number of vehicles (vehicles) sensed by the vehicle sensor Sc on the access road c in the last cycle;

Cp is the length of the last cycle;

S1 is a saturation traffic flow rate (vehicles/sec) on the access road a; and

S3 is a saturation traffic flow rate (vehicles/sec) on the access road c.

The saturation traffic flow rate referred to herein is defined as a maximum traffic volume that can be flown on a road in the absence of interruption, such as waiting on a red light.

The load factor λ2 is one of (Q2/Cp+q2)/S2 and (Q4/Cp+q2)/S4 whichever is the greater (Step T7), where:

Q2 is the number of vehicles (vehicles) sensed by the vehicle sensor Sb on the access road b in the last cycle;

Q4 is the number of vehicles (vehicles) sensed by the vehicle sensor Sd on the access road d in the last cycle;

Cp is the length of the last cycle;

S2 is a saturation traffic flow rate (vehicles/sec) on the access road b; and

S4 is a saturation traffic flow rate (vehicles/sec) on the access road d.

Then, the difference obtained by subtracting the sum L of the predetermined constant times from the maximum cycle length (fixed value) $C_{max}$ of one cycle is distributed to the upper limit time $G_{max1}$ and the upper limit time $G_{max4}$ according to a ratio of the load factor λ1 and the load factor λ2 (Steps T8 and T9). Herein, a constant is given to the maximum cycle length (fixed value) $C_{max}$.

As has been described, a ratio of the load factor λ1 and the load factor λ2 is used herein, so that the difference obtained by subtracting the sum L of the predetermined constant times from the maximum cycle length (fixed value) $C_{max}$ is distributed to the upper limit time $G_{max1}$ and the upper limit time $G_{max4}$ according to the ratio of the load factor λ1 and the load factor λ2, and it should be noted that the invention is characterized in that the number of vehicles E1 and E2 waiting on a red light in the last cycle are taken into account when the load factor λ1 and the load factor λ2 are calculated.

If the upper limit time $G_{max1}$ and the upper limit time $G_{max4}$ are determined based on only the number of vehicles sensed in the last cycle without taking the number of vehicles E1 and E2 waiting on a red light, there is a drawback as follows.

When a traffic volume at an intersection increases to a certain degree, vehicles are running substantially at the saturation traffic flow rate on a green light. This fixes or almost fixes the values of both the load factor λ1 and the load factor λ2.

Assume that a traffic volume in one direction increases extremely, and a number of vehicles are waiting on a red light at an intersection. In this case, if the numbers of vehicles E1 and E2 waiting on a red light are not taken into account for the load factor λ1 and the load factor λ2 , a ratio of the load factor λ1 and the load factor λ2 takes an almost fixed value, and the upper limit time $G_{max1}$ and the upper limit time $G_{max4}$ are more or less the same as those when only a few vehicles are waiting on a red light.

On the contrary, when the number of vehicles waiting on a red light is taken into account, the upper limit time of the green light time is extended commensurately in the direction along which a number of vehicles are waiting on a red light at an intersection, which allows the green light time to be extended as needed. It is thus possible to prevent an undesirable event that a line of vehicles waiting on a red light in one direction at an intersection becomes so long that an upstream intersection is also blocked.

The calculation method of the upper limit times $G_{max1}$ and $G_{max4}$ described above may be modified in the manner as follows.

Figure 7:
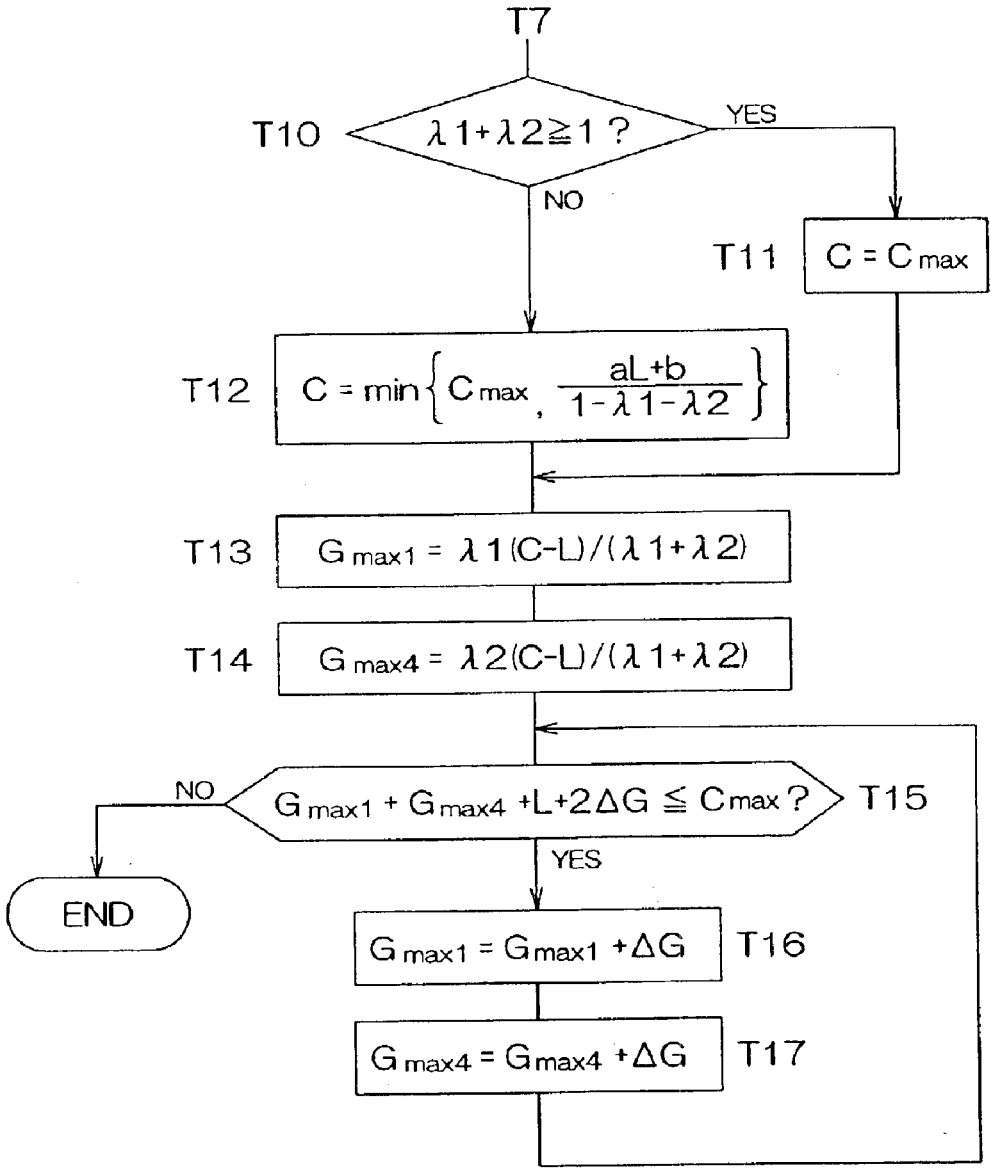
FIG. 7 is a partial flowchart detailing a modification of the calculating method of the upper limit times $G_{max1}$ and $G_{max4}$.

FIG. 7 is a partial flowchart detailing a modification of the calculation method of the upper limit times $G_{max1}$ and $G_{max4}$, which is continued from Step T7 of FIG. 6.

After the load factor $\lambda 1$ and the load factor $\lambda 2$ are determined, whether $\lambda 1+\lambda 2$ is greater than 1 is checked (Step T10). When the sum is greater than or equal to 1, a cycle length C corresponding to the current traffic situation is set to the maximum cycle length (fixed value) $C_{max}$ in Step T11.

When $\lambda 1+\lambda 2$ is less than 1, the cycle length C corresponding to the current traffic situation is set to one of the maximum cycle length (fixed value) $C_{max}$ and $(aL/+b)/(1-\lambda 1-\lambda 2)$ whichever is the smaller (Step T12). Herein, a and b are constants.

The difference obtained by subtracting the sum L of the predetermined constant times from the cycle length C is distributed to the upper limit time $G_{max1}$ and the upper limit time $G_{max4}$ according to a ratio of the load factor $\lambda 1$ and the load factor $\lambda 2$ (Steps T13 and T14).

Subsequently, an extension unit $\Delta G$ is added to both the upper limit time $G_{max1}$ and the upper limit time $G_{max4}$ (Steps T16 an T17). The addition is repeated until the cycle length C reaches the maximum cycle length (fixed value) $C_{max1}$ (Step T15).

The upper limit time $G_{max1}$ and the upper limit time $G_{max4}$ are determined eventually in this manner.

According to the method of FIG. 6, a longer extension time is given to a green light in PHASE currently having the heavier traffic volume, whereas according to the method of FIG. 7, it is possible to prevent the green light time in one direction from becoming extremely longer than in the other direction by adding the extension time $\Delta G$ to the green light time evenly in each PHASE. This method can therefore respond to an increase of a traffic volume in either PHASE.

What is claimed is:

1. A traffic signal control method for setting a green light time to a value between a lower limit time and an upper limit time in real time depending on a traffic volume sensed by a vehicle sensor, wherein:

an evaluation value is found for each phase, the evaluation value being a sum of the traffic volume in a past cycle and a set value given to the number of vehicles waiting on a red light in a case where the green light time in a last cycle had reached the upper limit time, and in a case where the green light time in the last cycle had not reached the upper limit time, the evaluation value being the traffic volume in the past cycle; and a longer upper limit time is allocated to a phase in question as the evaluation value becomes greater, and a shorter upper limit time is allocated to the phase in question as the evaluation value becomes smaller.

2. A traffic signal control method for performing processing (a) through processing (d) as follows:

(a) in a case where a green light dine in a last cycle had reached an upper limit time, a load factor $\lambda$ in one phase is found in accordance with an equation: $\lambda=(Q+E)/S$, where Q is the number of vehicles (vehicles/time) on an access road corresponding to the phase sensed in a past cycle, E is a set value given to the number of vehicles (vehicles/time) waiting on a red light on the access road corresponding to the phase, and S is a saturation traffic volume (vehicles/time) on the access road corresponding to the phase, and in a case where the green light signal in the last cycle had not reached the upper limit time, the load factor is calculated in accordance with an equation:

$$\lambda=Q/S;$$

(b) the processing (a) is performed for any other phase;

(c) when the processing (a) is completed for all phases, an upper limit time for each phase is determined by distributing a value obtained by subtracting a predetermined constant time L from a maximum cycle length (fixed value) to the upper limit times in respective phases according to a ratio of the load factors $\lambda$ in the respective phases; and (d) a green light time in a phase in question is set to a value between a lower limit time and the upper limit time, determined in the processing (c) above, in real time depending on a traffic volume sensed by a vehicle sensor.

3. The traffic signal control method according to either of claims 1 or 2, wherein, of a plurality of phases involved in traffic signal control at an intersection, the traffic signal control is performed for a part of the phases.

* * * * *